US006530101B1

(12) United States Patent
Nottingham

(10) Patent No.: US 6,530,101 B1
(45) Date of Patent: Mar. 11, 2003

(54) STRAND BRIDGE

(75) Inventor: William Dennis Nottingham, Anchorage, AK (US)

(73) Assignee: Peratrovich, Nottingham & Drage, Inc., Anchorage, AK (US)

( * ) Notice: Subject to any disclaimer, the term of this patent is extended or adjusted under 35 U.S.C. 154(b) by 0 days.

(21) Appl. No.: 09/627,922

(22) Filed: Jul. 28, 2000

Related U.S. Application Data

(60) Provisional application No. 60/146,931, filed on Jul. 30, 1999.

(51) Int. Cl.[7] ..... E01D 11/00
(52) U.S. Cl. ..... 14/20; 14/21
(58) Field of Search ..... 14/18, 19, 20, 14/21, 77.1, 2

(56) References Cited

U.S. PATENT DOCUMENTS

| | | | | | |
|---|---|---|---|---|---|
| 11,818 | A | | 10/1854 | Yandell et al. | |
| 63,901 | A | | 8/1867 | James | |
| 282,024 | A | | 7/1883 | Young | |
| 418,777 | A | | 1/1890 | Akers | |
| 436,606 | A | * | 9/1890 | Lantz | 14/21 |
| 438,070 | A | | 10/1890 | Eddy | |
| 478,438 | A | | 7/1892 | Kosure | |
| 629,935 | A | | 8/1899 | Sturgis | |
| 1,019,458 | A | * | 3/1912 | Greer | 14/20 |
| 1,095,202 | A | * | 5/1914 | Friend | 14/19 |
| 2,221,919 | A | | 11/1940 | Kenan | 14/19 |
| 2,266,549 | A | * | 12/1941 | Hamilton | 14/18 |
| 2,339,925 | A | * | 1/1944 | Haupt | 14/18 |
| 2,417,825 | A | | 3/1947 | Janke, Sr. | 14/3 |
| 3,377,637 | A | | 4/1968 | Zamorano | 14/24 |
| 4,454,620 | A | | 6/1984 | Barkdull, Jr. | 14/20 |
| 4,741,063 | A | * | 5/1988 | Diana | 14/18 |
| 4,837,885 | A | | 6/1989 | Yang | 14/21 |
| 5,615,436 | A | * | 4/1997 | Brown | 14/18 |

* cited by examiner

*Primary Examiner*—Thomas B. Will
*Assistant Examiner*—Meredith C. Petravick
(74) *Attorney, Agent, or Firm*—Seed IP Law Group PLLC

(57) ABSTRACT

A multiple-use, cable-supported bridge in which the primary lateral and vertical deck-stiffening elements are prestressed cables, or strands, extending along one or both sides of the bridge, and methods of fabricating such bridges, are shown and described. One embodiment of the strand bridge of the present invention is designed to span from a first location to a second location. A first anchor member is fixed near the first location and an opposing second anchor member is fixed near the second location. A number of tensioned cables extend between the first and second anchor members. At least one post is attached to the cables at a point between the first and second anchor members. A cross member is attached to the post and projects from the post in a direction transverse to the lengths of the cables. Decking material extends from the first location to the second location, and can be coupled to the cross member.

20 Claims, 8 Drawing Sheets

STRAND BRIDGE

CROSS-REFERENCE TO RELATED APPLICATION

This application claims priority from U.S. Provisional Patent Application No. 60/146,931, filed Jul. 30, 1999, which has abandoned since the filing of the application.

TECHNICAL FIELD

The present invention relates to bridges and, more particularly, to suspension bridges and other cable-supported bridges.

BACKGROUND OF THE INVENTION

Suspension bridges and other cable-supported bridges have been used for well over a century to span ravines, rivers and other obstructions to travel. Examples of such bridges can be seen in U.S. Pat. No. 11,818 to Yandell et al.; U.S. Pat. No. 418,777 to Akers; U.S. Pat. No. 438,070 to Eddy; and U.S. Pat. No. 478,438 to Kosure. These four patents generally illustrate the five key structural elements of a cable-supported bridge: (1) towers and foundations; (2) anchors; (3) suspension cables; (4) deck-stiffening elements; and (5) decking.

As illustrated in the above patents, these five elements can have various configurations. One consistent aspect of cable-supported bridges, however, is that the deck-stiffening element incorporates a rigid member, such as a beam or stringer, or incorporates a truss. Beams and stringers can be heavy and cumbersome, and consequently can be difficult and/or expensive to install. Similarly, trusses can be complicated and time consuming to assemble.

SUMMARY OF THE INVENTION

The present invention is directed toward multiple-use, cable-supported bridges in which the primary lateral and vertical deck-stiffening elements are prestressed cables, or strands, extending along one or both sides of the bridge, and to methods of fabricating such bridges. Several embodiments of the present invention allow workers to erect a bridge without extending large or cumbersome structural members across the span, and without fabricating trusses across the span.

One embodiment of the strand bridge of the present invention is designed to span from a first location to a second location. A first anchor member is fixed near the first location and an opposing second anchor member is fixed near the second location. A number of tensioned cables extend between the first and second anchor members. At least one post is attached to the cables at a point between the first and second anchor members. A cross member is attached to the post and projects from the post in a direction transverse to the lengths of the cables. Decking material extends from the first location to the second location, and can be coupled to the cross member.

Another embodiment of the strand bridge incorporates a pair of first anchor members and a pair of opposing second anchor members. A number of first tensioned cables are tensioned between the first anchor members, and a plurality of second tensioned cables are tensioned between the second anchor members. At least one first post is attached to the first cables at a point between the first and second locations, and a corresponding second post is attached to the second cables. A cross member extends between the first and second posts. Decking extends from the first location to the second location, and can be coupled to the cross member.

The present invention is also directed toward a method of fabricating strand bridges, such as the bridges described in the above embodiments.

BRIEF DESCRIPTION OF THE DRAWINGS

FIG. 8(*b*) is a partial sectional plan view of the portion of the anchor member of FIG. 8(*a*), viewed along Section 8B.

DETAILED DESCRIPTION OF THE ILLUSTRATED EMBODIMENTS

The present detailed description is generally directed toward cable-supported bridges in which the vertical and lateral deck-stiffening elements are tensioned cables extending at least a portion of the length of the bridge. Many specific details of certain embodiments of the invention are set forth in the following description and in FIGS. 1–12 to provide a thorough understanding of such embodiments. One skilled in the art, however, will understand that the present invention may have additional embodiments, or that the invention may be practiced without several of the details described in the following description.

Figure 1:
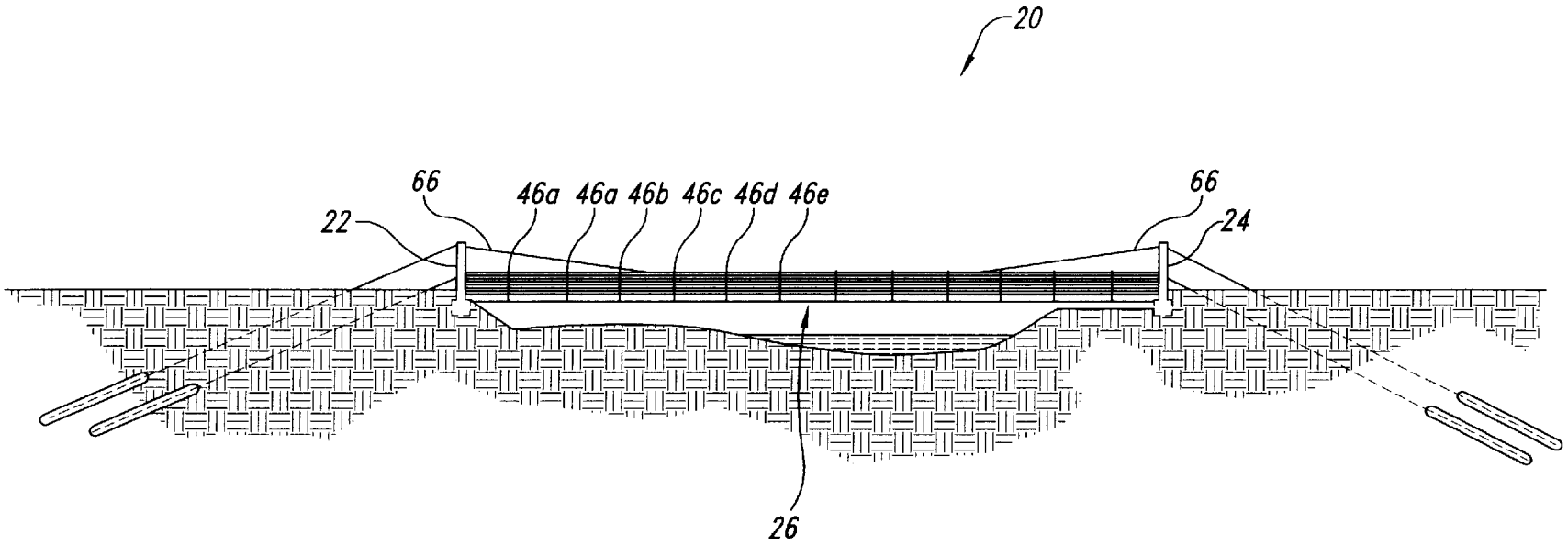
FIG. 1 is a schematic elevation view of a strand bridge according to an embodiment of the present invention.

FIG. 1 illustrates a strand bridge 20 according to an embodiment of the present invention. The strand bridge 20 spans across a stream, river or other obstruction from a first location to a second location. The strand bridge 20 can have a first anchor member 22 fixed near the first location and second anchor member 24 fixed near the second location. In the illustrated embodiment, the strand bridge 20 has two first anchor members 22 and two corresponding second anchor members 24. It is understood that, under varying circumstances, more or fewer anchor members can be used on one or both ends of the bridge.

A number of tensioned cables 26 extend between the first anchor member 22 and the second anchor member 24. As described in detail below, in this embodiment of the present invention the tensioned cables 26 are attached to the first and second anchor members 22/24, and are maintained in tension to collectively serve as vertical and horizontal deck-stiffening elements.

Figure 2:
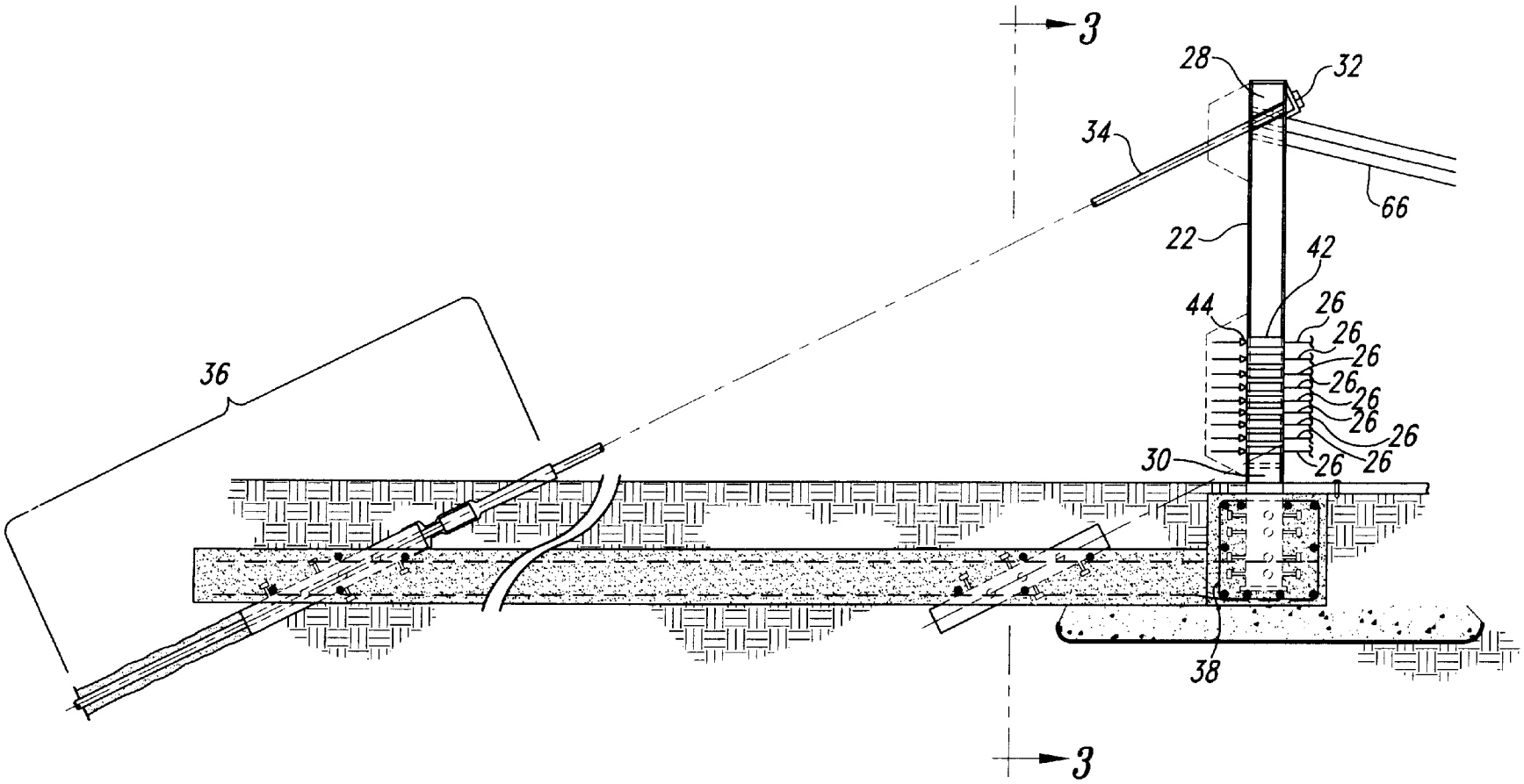
FIG. 2 is an enlarged elevation view of a portion of the strand bridge of FIG. 1.
Figure 3:
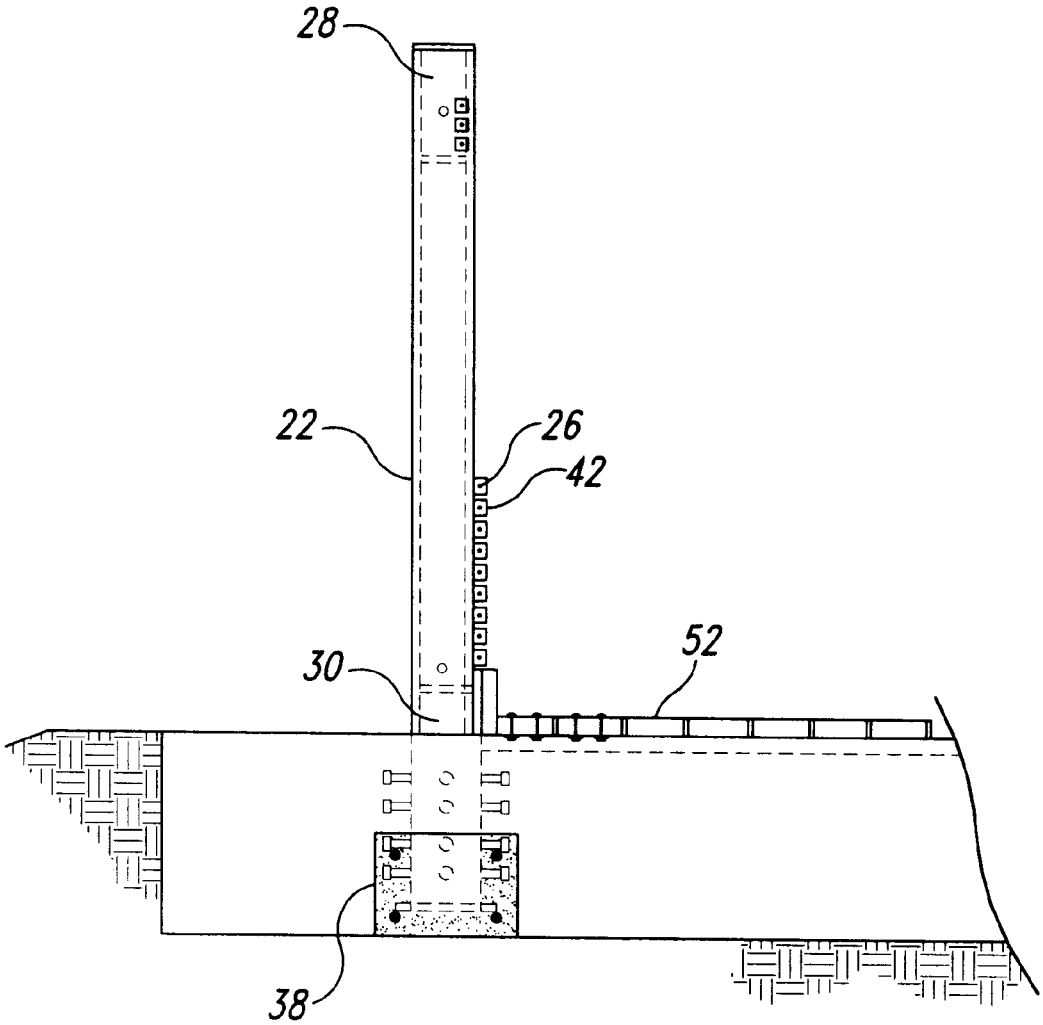
FIG. 3 is an end view of the portion of the strand bridge illustrated in FIG. 2, viewed along Section 3—3.

FIGS. 2 and 3 illustrate the first anchor member 22 and one possible system for anchoring the first anchor member. The second anchor member 24 (FIG. 1) can be the same or similar to the first anchor member 22, and therefore this description of the first anchor member can also serve as a description of the second anchor member.

The first anchor member 22 in the illustrated embodiment is an elongated structural member having an upper end 28 and an opposing lower end 30. The first anchor member 22 can have a hollow rectangular cross section or can have another suitable shape, such as an angle member, channel member, or an I-beam. The first anchor member 22 can be fabricated from steel or any other suitable material. The size, shape and material of the first anchor member 22 can be selected based on the structural requirements of a particular situation.

FIG. 2 illustrates how the anchor member 22 of this embodiment is anchored to the ground. An anchor fastening assembly 32 is coupled to the anchor member 22 near its upper end 28. The anchor fastening assembly 32 is oriented on the first anchor member 22 to face the span of the bridge, which is to the right in FIG. 2. An anchor rod 34 extends through the first anchor member 22 and is fastened to the anchor fastening assembly 32. Opposite the anchor fastening assembly 32, the anchor rod 34 is attached to an anchor 36. The size, shape and material of the anchor rod 34 and anchor 36 can be selected as understood in the field to satisfy the forces on the anchor member 22, the soil condition or other design conditions. In addition to being anchored to the ground, it is understood that the present invention can be anchored to a structure using components generally understood in the art.

The lower end 30 of the first anchor member 22 is attached to a footing 38. The size and shape of the footing 38, and the manner of attaching the first anchor member 22 to the footing, can be selected as understood in the field to accommodate the expected forces on the first anchor member.

A plurality of the tensioned cables 26 are attached to the first anchor member 22 near its lower end 30, above grade. As illustrated in FIG. 1, one end of each tensioned cable 26 is attached to the first anchor member 22 and an opposing end of each tensioned cable is attached to the second anchor member 24. Each tensioned cable 26 extends through a cable guide 42, and projects beyond the first anchor member 22. Each tensioned cable 26 is retained under tension by a locking assembly 44 (FIG. 2) positioned between the tensioned cable 26 and the cable guide 42. The locking assembly 44 can be a wedge or any other suitable mechanism generally understood in the art.

In the illustrated embodiment, each tensioned cable 26 measures roughly one-half inch in diameter, contains seven wire strands, and is coated with an epoxy coating. The number of wire strands in the tensioned cable 26, the diameter of each strand and the overall diameter of the cable, and the type of polymer or epoxy coating the cable can all be varied depending on the structural conditions as well as other factors. The cable can also be uncoated, galvanized or painted. In the illustrated embodiment, each tensioned cable 26 is tensioned under a force of up to 29,000 pounds. A cable stressed by this force is elastically deformed in a manner similar to prestressing re-bar for structural construction materials. This force can vary based on the size or material of the cables or the exact design of the bridge.

Figure 4:
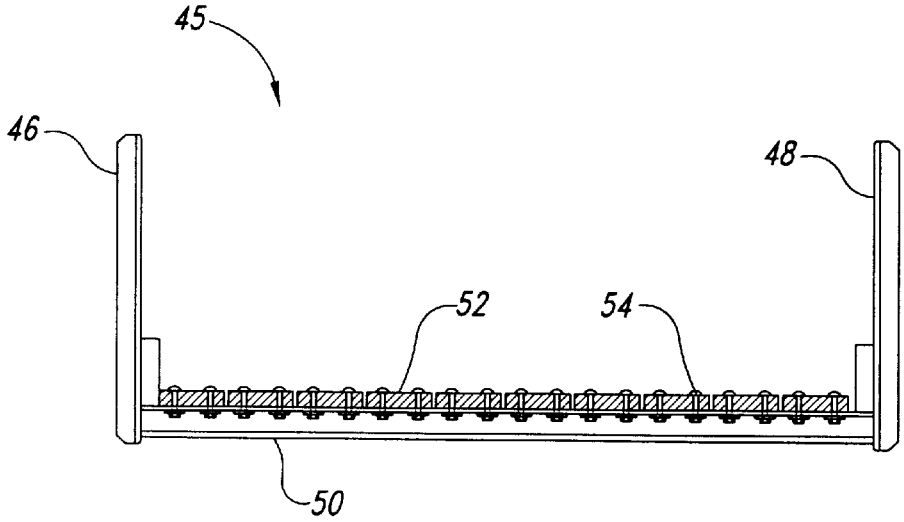
FIG. 4 is an enlarged end view of a cross member of the strand bridge of FIG. 1.

FIG. 4 illustrates a mid-span assembly 45 for the strand bridge 20 (FIG. 1). The mid-span assembly 45 includes a first post 46, a second post 48, and a cross-member 50. In the illustrated embodiment, the cross member 50 is attached at one end to the first post 46 and at an opposite end to the second post 48. The first and second posts 46/48 can be fabricated from angle bar, I-beams, or other structural members, and can measure approximately 4 ft., 6½ inches. In the illustrated embodiment, the cross member 50 is an I-beam measuring roughly 6 inches high. The first and second posts 46/48 and the cross member 50, however, can have different shapes and sizes, and can be made from a variety of materials, such as steel. As illustrated in FIG. 1, a mid-span assembly having a first post 46 can be attached at regular intervals along the span of the strand bridge 20 (see reference nos. 46*a*–46*e*). The total number of mid-span assemblies 45, the spacing between each assembly, and the distance from the first and second anchor members 22/24 to the nearest mid-span assembly can vary depending on the length of the span and other factors.

Decking 52 extends from one cross-member 50 to an adjacent cross member or anchor member, and can be attached to each cross member by fasteners 54. In the illustrated embodiment, the decking 52 is made up of a number of wooden boards. It is understood, however, that the decking 52 can be made from pre-cast concrete sections, from metal pans filled with asphalt or concrete, or from other materials generally known in the art, such as plastic or composites.

The two cross members 50 to which a particular section of the decking 52 is attached can be adjacent each other, or the decking can span three or more cross members before it terminates at the next attachment point. The particular configuration can vary depending on the spacing of the mid-span assemblies 45 or the length of the decking 52.

Figure 5:
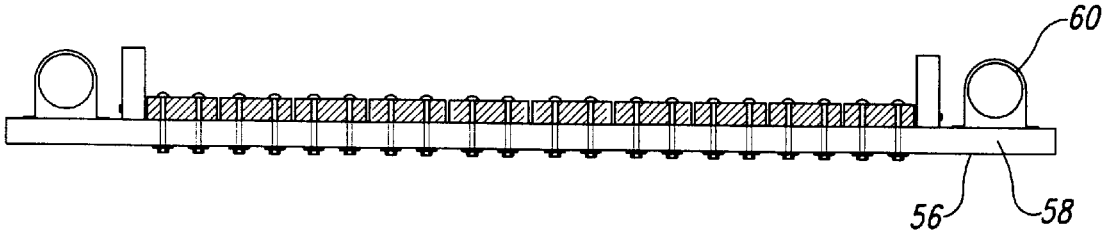
FIG. 5 is an enlarged end view of a portion of the strand bridge of FIG. 4 between cross members.
Figure 6:
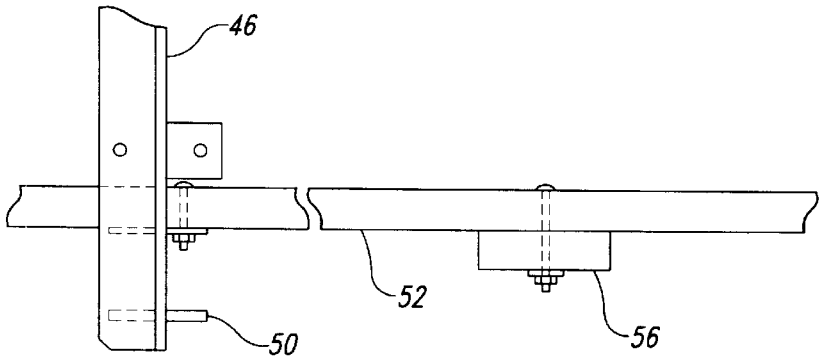
FIG. 6 is an enlarged side view of another portion of the strand bridge of FIG. 1.
Figure 7A:
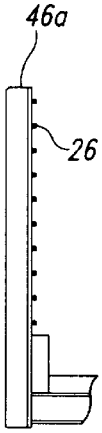
FIGS. 7(*a*)–7(*e*) are enlarged end views of a number of posts of the strand bridge of FIG. 1.
Figure 7B:
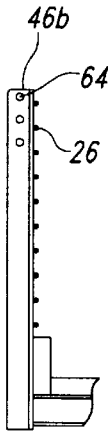
Figure 7C:
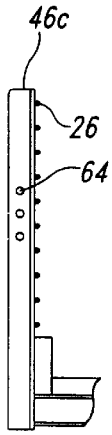
Figure 7D:
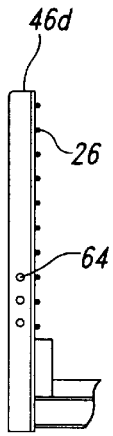
Figure 7E:
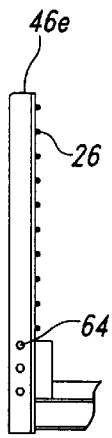
Figure 8A:
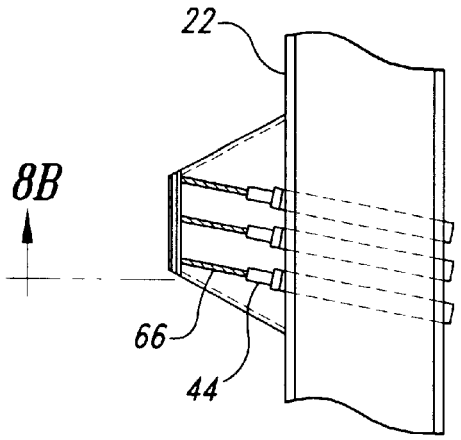
FIG. 8(*a*) is an enlarged partial elevation view of an anchor member of the strand bridge of FIG. 1.
Figure 8B:
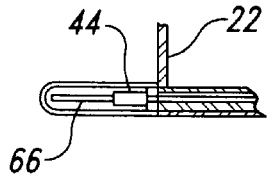

Between each pair of cross members 50, as illustrated in FIGS. 5 and 6, a stabilizer 56 can be oriented in a transverse direction with respect to the decking 52, and can be attached to the decking to stiffen the deck of the strand bridge 20 between cross members. The stabilizer 56 of the present embodiment is oriented perpendicular to the decking 52, and is positioned underneath the decking.

One or both ends of the stabilizer 56 can project beyond the decking 52 to a location outside of the tensioned cables 26. The projecting portion of the stabilizer 56 creates a cantilevered shelf 58. A utility line 60, such as a water pipe or conduit for electrical wiring, can be attached to the cantilevered shelf 58 and can extend along the length of the strand bridge 20 from one side to the other. The utility line 60 can provide additional torsional stability to the strand bridge 20.

Figure 9:
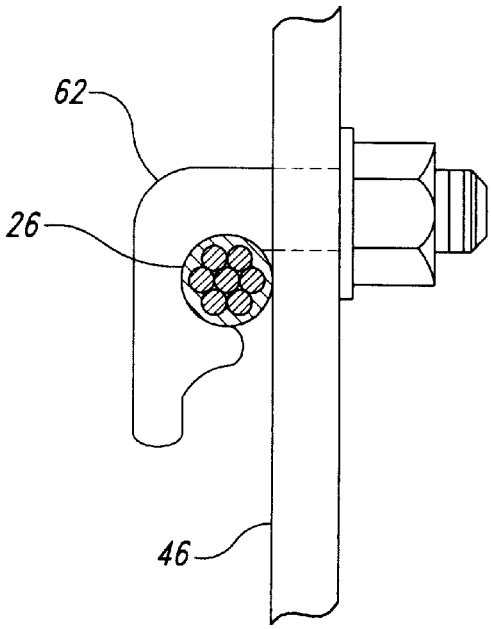
FIG. 9 is an enlarged end view of a tensioned cable, a clamp and a portion of a post from the strand bridge of FIG. 1.

FIGS. 7(*a*)–7(*e*) illustrate a number of possible first or second posts 46/48 for installation at different points along the span of the strand bridge 20. The tensioned cables 26 are attached to an interior surface of the first or second post 46/48 by a fastener such as the clamp 62 (FIG. 9). In the illustrated embodiment, there are ten tensioned cables 26. The tensioned cables 26 on each of the first and second posts 46/48 can also serve as a guard rail for the strand bridge 20. As understood in the industry, the local building code will provide the minimum height for the railing and the maximum spacing between cables (typically four inches). A number of suspension cable apertures 64 can be oriented at various locations along the first and second posts 46/48, as illustrated in FIGS. 7(*a*)–7(*e*). The suspension cable apertures 64 are positioned to correspond to the position of suspension cables 66 (FIG. 1) at the respective locations along the strand bridge 20. As illustrated in FIG. 2, the suspension cables 66 are fastened near the upper end 28 of the first and second anchor members 22/24 and slope downward toward the center of the span of the strand bridge 20.

As illustrated in FIGS. 1 and 7, the various first posts 46(*a*)–46(*e*) and corresponding second posts 48(*a*)–48(*e*) (not shown) are positioned at different locations along the span of the strand bridge 20. The first post 46(*a*) illustrated in FIG. 7(*a*) can be positioned near the beginning or the end of the span, at a point where the suspension cables 66 are above the top of the first post 46(*a*). The first posts 46 illustrated in FIGS. 7(*b*)–7(*e*) are positioned progressively closer to the center of the span of the strand bridge 20. As the suspension cables 66 approach the center of the span, the relative heights of the suspension cables 66 with respect to the strand bridge 20 decrease and the heights of the suspension cable apertures 64 accordingly decrease.

Figure 10A:
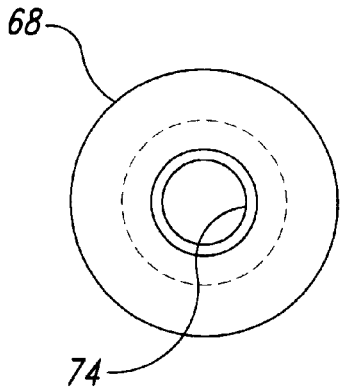
FIGS. 10(*a*) and 10(*b*) are elevation and side views, respectively, of a first bushing member from the strand bridge of FIG. 1.
Figure 10B:
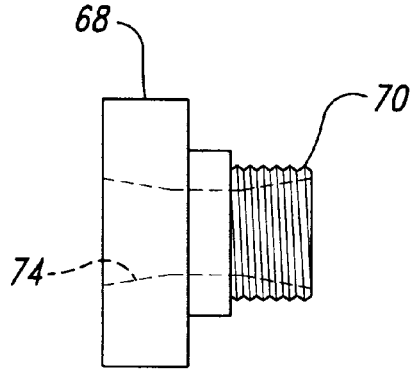

FIGS. 10(*a*), 10(*b*), 11(*a*) and 11(*b*) illustrate a first bushing member 68 and a second bushing member 69, respectively. The first and second bushing members 68/69 can be assembled to form a bushing that fits within the suspension cable aperture 64 and which receives the suspension cable 66. The first bushing member 68 has a threaded end 70 and the second bushing member 69 has a complementary threaded opening 72 for engaging the threaded end. The threaded end 70 of the first bushing member 68 can be inserted through the suspension cable aperture 64, and the threaded opening 72 on the second bushing member 69 engaged with the threaded end 70 on the first bushing member to form a bushing in the suspension cable aperture 64. The first bushing member 68 has a throat 74 that is curved to distribute the force that the suspension cable 66 exerts on the first bushing member 68. The first and second bushing members 68/69 of the illustrated embodiment are fabricated from high density polyethylene ("HDPE"). The first and second bushing members 68/69 can be fabricated from other hard plastics or other suitable materials.

During installation, the first and second anchor members 22/24 are erected first onto their footings 38, then anchored toward the side opposite where the span will be erected. The tensioned cables 26 are then extended through the first and second anchor members 22/24. One end of each of the tensioned cables 26 is attached to either the first or second anchor member 22/24. The other end of each of the tensioned cables 26 is then tensioned, such as by a jack or other tensioning device and attached with a locking assembly 44 to the other of the first or second anchor members 22/24. In the illustrated embodiment, a row of tensioned cables 26 is erected on each side of the bridge.

After the tensioned cables 26 are installed, the mid-span structural assemblies 45 are installed in the order illustrated in FIGS. 1 and 7. Each of the first and second posts 46/48 are attached by a clamp 62 (FIG. 9) to each tensioned cable 26. The decking 52 can then be laid across and attached to the cross member 50 of each mid-span assembly 45. After the decking 52 has been laid, the stabilizers 56 can be attached to the underside of the decking between each of the cross members 50. The tensioned cables 26 can serve as rails on which to roll the bridge elements out to the location along the span at which they are to be installed. A trolley or other rolling device can be placed on the tensioned cables near either end of the span, loaded with materials, then rolled along the tensioned cables to the location at which the materials will be installed.

Figure 11A:
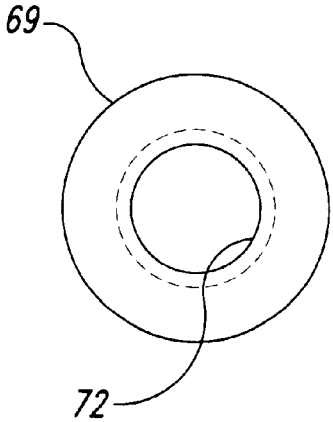
FIGS. 11(*a*) and 11(*b*) are elevation and side views, respectively, of a second bushing member from the strand bridge of FIG. 1.
Figure 11B:
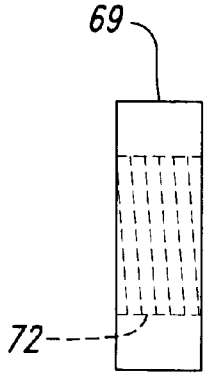

At this point, the suspension cables 66 can be installed. The bushings illustrated in FIGS. 10 and 11 are first assembled in each of the suspension cable apertures 64. Suspension cables 66 can then be extended from the first anchor member 22, through each of the suspension cable apertures 64 in the proper mid-span assembly, and through the upper end 28 of the second anchor member 24. The suspension cables 66 are then attached to one of the first or second anchor members 22/24, and tensioned to give the strand bridge 20 the desired configuration. The suspension cables 66 are then locked to the other of the first or second anchor members 22/24.

The illustrated strand bridge has a number of advantages over conventional cable-supported bridges. First, the deck is stiffened in the vertical and lateral directions without the use of conventional trusses or beams, but instead by using prestressed cables. Using a number of tensioned cables instead of rigid structural members and instead of trusses can reduce the time and money involved in transporting the bridge elements to the site and erecting the bridge.

Second, the tensioned cables not only stiffen the deck, but also serve as railings for the bridge. This can further reduce the number of structural members required to fabricate the bridge.

Third, the materials used to fabricate the first and second bushing members, as well as the shape of the throat of the bushing, can distribute the forces between the suspension cables and the bushings and thereby reduce the likelihood that (or increase the time duration until) the bushings will need repair or replacement.

Embodiments of the present invention can be designed to span a distance greater or less than that of the first embodiment. Consequently, the sizes, shapes, and configurations of many of the elements of the bridge can be modified as necessary to compensate for the varying configurations.

Figure 12:
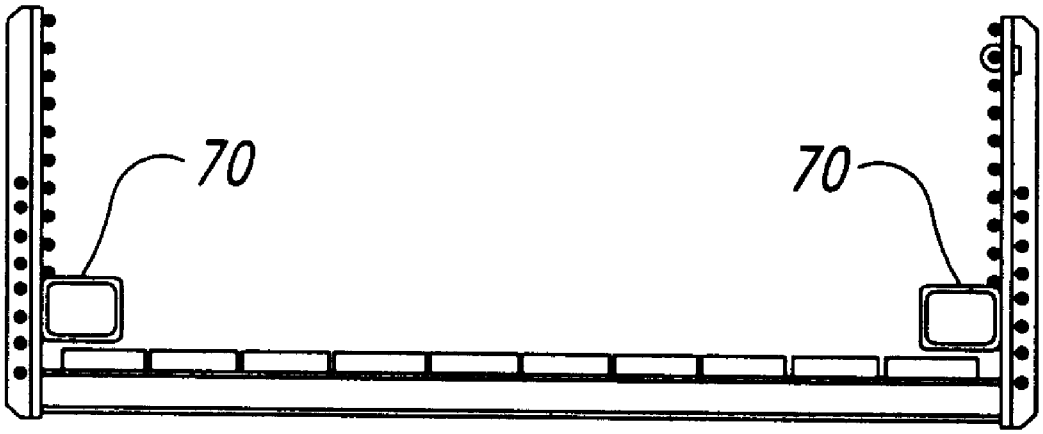
FIG. 12 is a sectional end view of a portion of a strand bridge according to an alternate embodiment of the present invention.

One alternate embodiment of the present invention is illustrated in FIG. 12. In this particular embodiment, one or two curbs 70 can be mounted near the lateral sides of the strand bridge. The curbs 70 can be fabricated from conduit, pipe, wood or other materials, and can have various sizes and cross-sectional shapes, such as rectangular or circular. The curbs 70 extending along the sides of the strand bridge can resist twisting and therefore provide torsional stiffening to the bridge.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A bridge for spanning a distance in a first direction between a first fixed location and a second fixed location, the bridge comprising:

an elongated first anchor member having a first length, the first anchor member having a first portion and a second portion spaced apart from the first portion along the first length, the first portion of the first anchor member adapted for being fixedly anchored near the first fixed location with the first length extending in a second direction non-parallel with the first direction, the second portion of the first anchor member having a plurality of first engagement elements distributed along the second portion of the first length;

an elongated second anchor member having a second length, the second anchor member having a first portion and a second portion spaced apart from the first portion along the second length, the first portion of the second anchor member adapted for being fixedly anchored near the second fixed location with the second length extending in a third direction non-parallel with the first direction, the second portion of the second anchor member having a plurality of second engagement elements distributed along the second portion of the second length;

a plurality of cables aligned vertically and configured to be independently tensioned between the first and second anchor members prior to further fabrication of the bridge, each cable having first and second ends, the first end of each of the cables being configured to be fixedly coupled to one of the first engagement elements on the first anchor member and the second end of each of the cables being configured to be fixedly coupled to a corresponding one of the second engagement elements on the second anchor member such that each of the plurality of cables will be elastically deformed when tensioned, and the plurality of cables will be substantially parallel to each other within a vertical plane and distributed along a portion of a height of the bridge, the first and second engagement elements being configured to retain the cables in substantial tension such that the entire bridge requires no longitudinal beam or truss;

at least one cross member having a first portion and a second portion, the first portion of the cross member having a plurality of fasteners configured to be fixedly coupled to the plurality of cables tensioned between the first and second anchor members at a central location between the first and second fixed locations, the second portion of the cross member being angled with respect to the first portion such that the second portion lies substantially within a horizontal plane and extends transverse to the first direction when the first portion is coupled to the tensioned cables; and a plurality of decking members configured to extend from the first fixed location to the second fixed location, a portion of the decking members being supported by the at least one cross member.

2. The bridge of claim 1 comprising a pair of first anchor members configured to be spaced apart from each other by a width of the bridge near the first fixed location and a pair of second anchor members configured to be spaced apart from each other by the width of the bridge near the second fixed location, wherein the tensioned cables are configured to extend between one of the first anchor members and a corresponding one of the second anchor members, further comprising a plurality of second tensioned cables configured to extend between the other of the first anchor members and a corresponding other of the second anchor members.

3. The bridge of claim 1 wherein the first and second engagement elements comprise apertures in the first and second anchor members, respectively.

4. The bridge of claim 1 wherein the plurality of cables comprises ten cables.

5. The bridge of claim 1 wherein the engagement elements are oriented to align the cables vertically when the bridge is fabricated.

6. The bridge of claim 1 wherein the engagement elements on the first and second anchor members are spaced to distribute the cables from a first location near a bridge deck to a second location sufficiently high to serve as a railing to retain people on the bridge.

7. The bridge of claim 1 wherein the engagement elements on the first and second anchor members are oriented to align the cables vertically when the bridge is fabricated, and are spaced to distribute the cables evenly from a first location near a bridge deck to a second location sufficiently high to serve as a railing to retain people on the bridge.

8. The bridge of claim 1 wherein the engagement elements on the first and second anchor members are oriented to align the cables vertically when the bridge is fabricated, and are spaced apart from each other by approximately four inches to distribute the cables evenly from a first location near a bridge deck to a second location sufficiently high to serve as a railing to retain people on the bridge.

9. The bridge of claim 1 wherein the plurality of cables comprises substantially more than two cables.

10. The bridge of claim 1 wherein the plurality of cables are tensioned by a force of approximately 29,000 pounds.

11. A bridge spanning a distance in a first direction between a first fixed location and a second fixed location, the bridge comprising:

a pair of elongated first anchor members each having a first length, the first anchor members each having a first portion and a second portion spaced apart from the first portion along the first length, the first portion of the first anchor members being fixedly anchored near the first fixed location with the first length extending in a second direction non-parallel with the first direction, the second portion of the first anchor members having a plurality of first engagement elements distributed along the second portion of the first length;

a pair of elongated second anchor members each having a second length, the second anchor members each having a first portion and a second portion spaced apart from the first portion along the second length, the first portion of the second anchor members being fixedly anchored near the second fixed location with the second length extending in a third direction non-parallel with the first direction, the second portion of the second anchor members having a plurality of second engagement elements distributed along the second portion of the second length;

a plurality of first cables aligned vertically and independently tensioned between one of the first anchor members and a corresponding one of the second anchor members, each first cable having first and second ends, the first end of each of the first cables being fixedly coupled to one of the first engagement elements on the first anchor member and the second end of each of the cables being fixedly coupled to a corresponding one of the second engagement elements on the second anchor member such that the plurality of first cables are elastically deformed and extend substantially parallel to each other in a vertical plane, the first and second engagement elements retaining the first cables in substantial tension;

a plurality of second cables independently tensioned between the other of the first and second anchor members, each second cable having first and second ends, the first end of each of the second cables being fixedly coupled to one of the first engagement elements on the first anchor member and the second end of each of the cables being fixedly coupled to a corresponding one of the second engagement elements on the second anchor member such that the plurality of second cables are elastically deformed and extend substantially parallel to each other, the first and second engagement elements retaining the second cables in substantial tension;

whereby the bridge requires no longitudinal beam or truss;

at least one cross member having a pair of first portions and a second portion, the first portions of the crow member each having a plurality of fasteners fixedly coupled to the plurality of the first and second cables, respectively, at a central location between the first and second fixed locations, the second portion of the cross member being coupled between the first portions such that the second portion lies substantially within a horizongal plane and extends transverse to the first direction; and a plurality of decking members extending from the first fixed location to the second fixed location, a portion of the decking members being supported by the at least one cross member.

12. The bridge of claim 11 wherein the first and second engagement elements are oriented in a vertical plane such that the plurality of first and second cables are aligned vertically with respect to each other.

13. The bridge of claim 11 wherein the first and second engagement elements are spaced apart from each other by a constant spacing and oriented to be in a vertical plane such that the plurality of first and second cables, respectively, are distributed evenly and aligned vertically with respect to each other.

14. The bridge of claim 11 wherein the plurality of cables are tensioned by a force of approximately 29,000 pounds.

15. The bridge of claim 11 wherein the first and second fixed locations are natural objects.

16. A method for fabricating a bridge between a first fixed location and a second fixed location up to a maximum span without the use a longitudinal beam or truss, the method comprising:

anchoring a first anchor member near the first fixed location;

anchoring a second anchor member near the second fixed location;

coupling a first end of each of a plurality of cables to the first anchor member in a vertical alignment; independently tensioning each of the plurality of cables under a force sufficient to elastically deform the cable; and coupling the second end of each of the plurality of cables to the second anchor member in a vertical alignment such that the plurality of cables remain under substantial tension such that the plurality of cables are oriented in a vertical plane; and extending decking members supported by the plurality of cables between the first and second fixed locations.

17. The method of claim 16 wherein the cables each have a diameter of approximately one-half inch and wherein tensioning the plurality of cables comprises applying a force of approximately 29000 pounds to each of the plurality of cables.

18. The method of claim 16 wherein the first and second anchor members each have a plurality of attachment members arranged substantially vertically, and wherein coupling the first and second ends of the plurality of cables comprises orienting the plurality of cables in a substantially vertical plane.

19. The method of claim 16 wherein the first and second anchor members each have a plurality of attachment members evenly spaced from each other and arranged substantially vertically, and wherein coupling the first and second ends of the plurality of cables comprises spacing the plurality of cables apart from each other and orienting the plurality of cables in a substantially vertical plane.

20. The method of claim 16 for bridges longer than the maximum span, further comprising:

coupling a first end of a suspension cable to the first anchor member at a location vertically above the plurality of cables;

coupling the suspension cable to a central location along the bridge; and coupling a second end of the suspension cable to the second anchor member at a location vertically above the plurality of cables, to further support the bridge.

* * * * *